US010403466B1

(12) United States Patent
Sommerer et al.

(10) Patent No.: US 10,403,466 B1
(45) Date of Patent: Sep. 3, 2019

(54) LOW SPUTTERING, CROSS-FIELD, GAS SWITCH AND METHOD OF OPERATION

(71) Applicant: General Electric Company, Schenectady, NY (US)

(72) Inventors: Timothy John Sommerer, Ballston Spa, NY (US); Svetlana Selezneva, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/933,602

(22) Filed: Mar. 23, 2018

(51) Int. Cl.

| | |
|---|---|
| ***H01J 17/14*** | (2006.01) |
| ***H01J 17/20*** | (2012.01) |
| ***H01J 17/06*** | (2006.01) |
| ***H01J 17/10*** | (2006.01) |

(52) U.S. Cl.
CPC ..... *H01J 17/14* (2013.01); *H01J 17/06* (2013.01); *H01J 17/10* (2013.01); *H01J 17/20* (2013.01)

(58) Field of Classification Search
CPC .. H01J 17/14; H01J 17/06; H01J 17/10; H01J 17/20
See application file for complete search history.

(56) References Cited

U.S. PATENT DOCUMENTS

| | | | |
|---|---|---|---|
| 3,638,061 | A | 1/1972 | Lutz et al. |
| 4,596,945 | A | 6/1986 | Schumacher et al. |
| 5,008,798 | A | 4/1991 | Harvey et al. |
| 5,019,752 | A | 5/1991 | Schumacher |
| 5,075,594 | A | 12/1991 | Schumacher et al. |
| 5,132,597 | A | 7/1992 | Goebel et al. |
| 5,329,205 | A | 7/1994 | Goebel et al. |
| 5,568,019 | A | 10/1996 | Mason et al. |
| 5,631,524 | A | 5/1997 | Matsuzaki et al. |

(Continued)

FOREIGN PATENT DOCUMENTS

| | | | |
|---|---|---|---|
| CN | 102176401 | B | 4/2013 |
| JP | 2012224886 | A | 3/2015 |
| WO | 2014142974 | A1 | 9/2014 |

OTHER PUBLICATIONS

Goebel, D., "High Power Modulator for Plasma Ion Implantation", Journal of Vacuum Science & Technology B, Nanotechnology and Microelectronics: Materials, Processing, Measurement, and Phenomena, http://avs.scitation.org/doi/abs/10.1116/1.587356, vol. 12, Issue 02, Jun. 1998.

(Continued)

*Primary Examiner* — Anne M Hines
(74) *Attorney, Agent, or Firm* — Armstrong Teasdale LLP

(57) ABSTRACT

A gas switch includes a gas-tight housing containing an ionizable gas, an anode disposed within the gas-tight housing, and a cathode disposed within the gas-tight housing, where the cathode includes a conduction surface. The gas switch also includes a control grid positioned between the anode and the cathode, where the control grid is arranged to receive a bias voltage to establish a conducting plasma between the anode and the cathode. In addition, the gas switch includes a plurality of magnets selectively arranged to generate a magnetic field proximate the conduction surface that reduces the kinetic energy of charged particles striking the conduction surface and raises the conduction current density at the cathode surface to technically useful levels.

18 Claims, 5 Drawing Sheets

(56) References Cited

U.S. PATENT DOCUMENTS

| | | | | |
|---|---|---|---|---|
| 5,828,176 | A * | 10/1998 | Goebel | H01J 17/14 315/111.41 |
| 6,433,480 | B1 | 8/2002 | Stark et al. | |
| 6,787,010 | B2 | 9/2004 | Cuomo et al. | |
| 7,825,595 | B2 | 11/2010 | Bochkov et al. | |
| 8,685,213 | B2 | 4/2014 | Kouznetsov et al. | |
| 9,520,801 | B1 | 12/2016 | She et al. | |
| 2015/0098259 | A1 | 4/2015 | Michael et al. | |
| 2016/0020057 | A1 | 1/2016 | Sommerer et al. | |

OTHER PUBLICATIONS

An-Jen et al., "Nano-ZnO Cold Cathodes for Controlling Plasma Switches", Nanotechnology, http://ieeexplore.ieee.org/document/1500809/, Sep. 6, 2005.

Li et al., "Finite element modeling of plasma initiation by carbon nanotubes (CNTs) as cold cathode in pseudospark switch Sign in or Purchase", Power Modulator and High Voltage Conference, http://ieeexplore.ieee.org/document/7287278/, Oct. 5, 2015.

Schonhuber, Max J. "Breakdown of gases below Paschen minimum: basic design data of high-voltage equipment." IEEE Transactions on Power apparatus and Systems 2 (1969): 100-107.

Goebel, Dan M. "Cold-cathode, pulsed-power plasma discharge switch." Review of scientific instruments 67, No. 9 (1996): 3136-3148.

Goebel, D.M. et al., "Low voltage drop plasma switch for inverter and modulator applications." Review of scientific instruments 64, No. 8 (1993): 2312-2319.

Guseva, L. G. "On discharge striking in polyatomic gases at pd<(pd) min." In Investigations into Electrical Discharges in Gases, pp. 1-11. 1964.

Goerz, D.A. et al.,"A low-profile high-voltage compact gas switch." In Pulsed Power Conference, 1997. Digest of Technical Papers. 1997 11th IEEE International, vol. 1, pp. 328-333. IEEE, 1997.

* cited by examiner

LOW SPUTTERING, CROSS-FIELD, GAS SWITCH AND METHOD OF OPERATION

STATEMENT REGARDING FEDERALLY SPONSORED RESEARCH AND DEVELOPMENT

This invention was made with Government support under contract number DE-AR0000298 awarded by the Department of Energy Advanced Research Projects Agency-Energy. The Government has certain rights in this invention.

BACKGROUND

The field of disclosure relates generally to a low sputtering, cross-field, gas switch and, more particularly, to a cross-field gas switch that reduces sputtering on a conduction surface of a cathode by reducing the kinetic energy of charged particles striking the conduction surface.

Cross-field gas switches, such as planar cross-field gas switches, are known. Conventionally, these switches include an electrode assembly, such as a cathode spaced apart from an anode, enclosed by a gas-tight chamber. The gas-tight chamber is filled with an ionizable gas, and a voltage is transiently applied to a control grid disposed between the anode and cathode to initiate a plasma path therebetween. The switch is operable, in the presence of an input voltage applied to the anode, to conduct a large electrical current between the anode and the cathode. The plasma path may be terminated by reverse biasing the control grid, such that the electrical current flowing from the anode to the cathode is transiently drawn off by the control grid (and accompanying circuitry), so that the gas between the control grid and anode can once again become insulating. Thus, the device functions as a gas filled switch, or "gas switch" in the presence of an input voltage and a conducting plasma.

Drawbacks associated with at least some known switches include heavy sputtering of cathode material during conduction. Specifically, many common gas switches experience a voltage drop of several hundred volts in the gap between the anode and the cathode. Typically, the large majority of this voltage drop (e.g., a "fall voltage") is experienced at or near a conduction surface of the cathode (e.g., within a "fall distance" of the conduction surface), resulting, in most cases, in thermal losses and "sputtering" of the cathode conduction surface by incident charged particles (positive ions) that gain energy from the fall voltage. Sputtering tends to reduce the useful life of the gas switch, such as, for example, to a matter of hours or days in a conduction mode. Thus, conventional gas switches tend not to be feasible for large-scale, long-term, implementation in power systems where reliability, cost, and lifecycle are important considerations.

BRIEF DESCRIPTION

In one aspect, a gas switch is provided. The gas switch includes a gas-tight housing containing an ionizable gas, an anode disposed within the gas-tight housing, and a cathode disposed within the gas-tight housing where the cathode includes a conduction surface. The gas switch also includes a control grid positioned between the anode and the cathode, where the control grid is arranged to receive a bias voltage to establish a conducting plasma between the anode and the cathode. In addition, the gas switch includes a plurality of magnets that raise the conduction current density at the cathode surface to technically useful levels. The magnets are further selectively arranged to generate a magnetic field proximate the conduction surface that reduces the kinetic energy of charged particles striking the conduction surface.

In another aspect, a gas switch is provided. The gas switch includes an anode, and a cathode defining an interior volume between the anode and the cathode. The gas switch also includes an ionizable gas filling the interior volume, and a system of magnets disposed proximate the cathode, where the system of magnets is selectively arranged to generate a magnetic field that reduces the kinetic energy of charged particles striking the cathode and that raises the conduction current density at the cathode surface to technically useful levels.

In yet another aspect, a method for manufacturing a gas switch is provided. The method includes providing a gas-tight housing, positioning a cathode within the gas-tight housing, the cathode including a conduction surface, selectively positioning an anode within the gas-tight housing, positioning a plurality of magnets proximate the cathode, where the plurality of magnets are arranged to reduce the kinetic energy of charged particles striking the conduction surface of the cathode during operation as well as to raise the conduction current density at the cathode surface to technically useful levels, and filling the gas-tight housing with an ionizable gas.

DRAWINGS

These and other features, aspects, and advantages of the present disclosure will become better understood when the following detailed description is read with reference to the accompanying drawings in which like characters represent like parts throughout the drawings, wherein.

Figure 1:
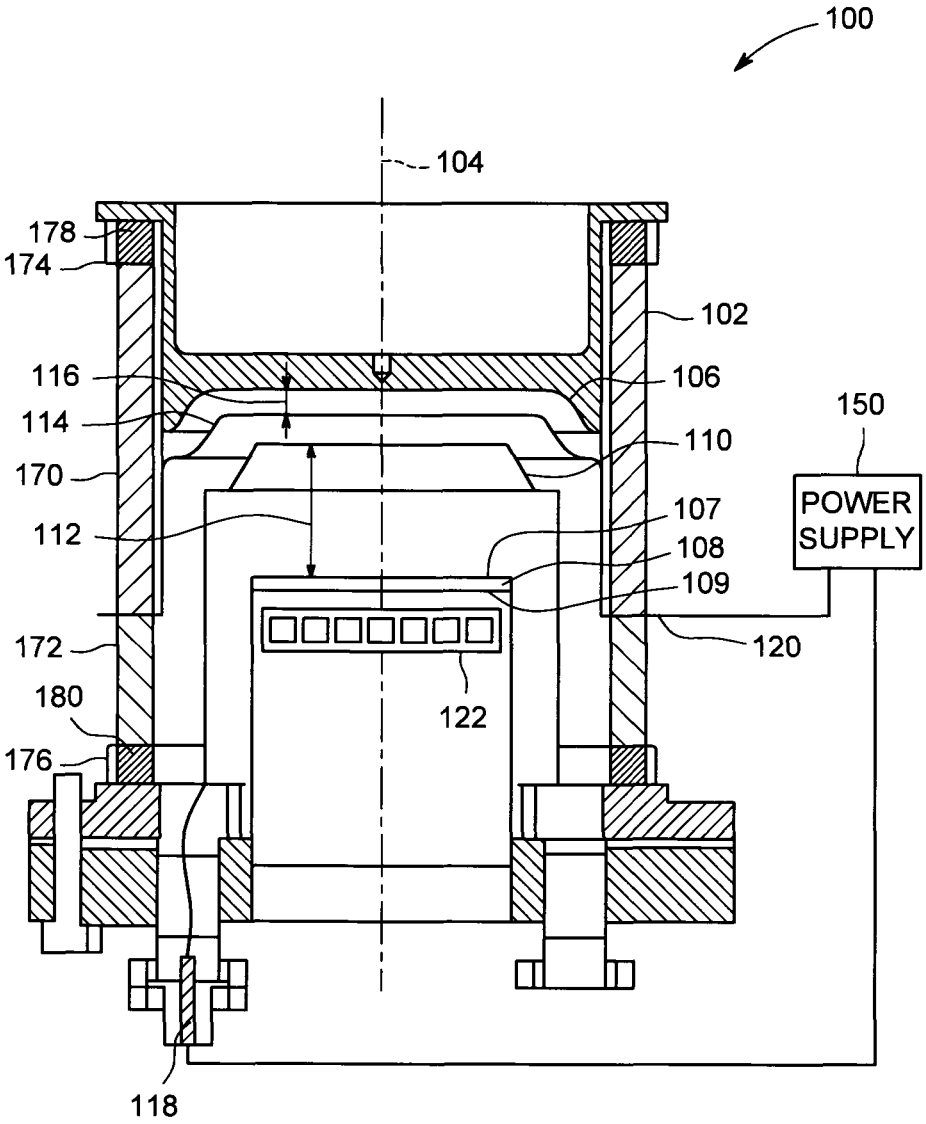
FIG. 1 is a cross-sectional view of an exemplary low sputtering, cross-field, gas switch.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, spatially relative terms, such as "beneath," "below," "under," "lower," "higher," "above," "over," and the like, may be used to describe one element or feature's relationship to one or more other elements or features as illustrated in the figures. It will be understood that such spatially relative terms are intended to encompass different orientations of the elements and features described herein both in operation as well as in addition to the orientations depicted in the figures. For example, if an element or feature in the figures is turned over, elements described as being "below" one or more other elements or features may be regarded as being "above" those elements or features. Thus, exemplary terms such as "below," "under," or "beneath" may encompass both an orientation of above and below, depending, for example, upon a relative orientation between such elements or features and one or more other elements or features.

Embodiments of the present disclosure relate to a gas switch that includes a system of magnets arranged in proximity to a cathode conduction surface. One or more design parameters associated with the system of magnets may be varied during manufacture to adjust the properties of a magnetic field strength generated by the system of magnets. For example, a location of a maximum magnetic field may be adjusted and/or a maximum magnetic field strength may be adjusted, such as by varying a distance between dipole magnets in the system of magnets and/or a magnetic field strength of the dipole magnets themselves. As the properties of the magnetic field are adjusted, the kinetic energy (e.g., the speed) of charged particles (e.g., positive ions) impacting the cathode conduction surface is reduced, facilitating a reduction in sputtering on the conduction surface. The probability that an incident ion will sputter an atom of cathode material decreases rapidly as the energy of the incident ion decreases, and is practically zero below some threshold ion energy that depends on the cathode material and the gas ion species.

FIG. 1 is a cross-sectional view of an exemplary low sputtering, cross-field, gas switch 100 (or "gas switch"). Gas switch 100 is generally cylindrical and includes a cylindrical gas-tight housing 102 that encloses and seals the various switch components described herein. A switch axis 104 extends through and is defined with respect to gas-tight housing 102. In the exemplary embodiment, gas-tight housing 102 includes an insulating material, such as a ceramic insulator. Further, as described below, a conductive ring 120 may be inserted and/or sealed between upper and lower portions of gas-tight housing 102 without affecting the gas-tightness and/or insulating properties of gas-tight housing 102.

For example, in some embodiments, gas-tight housing 102 comprises an upper cylindrical portion 170 and a lower cylindrical portion 172, where upper cylindrical portion 170 and lower cylindrical portion 172 are separated by and mechanically coupled through conductive ring 120. Thus, in at least some embodiments, gas-tight housing 102 is made up of upper cylindrical portion 170 and lower cylindrical portion 172 with conductive ring 120 sandwiched therebetween. In addition, in some embodiments, gas-tight housing 102 may include an upper metal ring 174 that is welded or otherwise electrically and mechanically coupled to an anode (as described below) and a lower metal ring 176 that is welded or otherwise electrically and mechanically coupled to a cathode (as described below). Further, in some embodiments, upper metal ring 174 may be surrounded by an upper mounting ring 178, and lower metal ring 176 may be surrounded by a lower mounting ring 180, each of which may facilitate a gas tight seal on gas-tight housing 102.

In the exemplary embodiment, gas switch 100 also includes an anode 106 and a cathode 108. Cathode 108 is axially separated (or spaced apart) from anode 106 and disposed in substantially parallel relationship to anode 106. Cathode 108 is substantially planar and includes an upper surface, such as a conduction surface 107, and a lower surface 109. As described herein, in some embodiments, one or both of anode 106 and cathode 108 may non-planar. For example, in some embodiments, cathode 108 includes an undulating or corrugated conduction surface 107. In other embodiments, however, conduction surface 107 is a smooth, planar, surface. Further, cathode materials may include tantalum, molybdenum, tungsten, gallium, gallium-indium, gallium-tin, gallium-indium-tin, aluminum, stainless steel, and/or any combination or alloy of these materials.

Another embodiment of gas switch 100 substitutes a concentrically arranged anode-cathode pair for the planar anode and cathode depicted at FIG. 1. In other words, in some embodiments, anode 106 and cathode 108 are not planar but cylindrical, such that a cylindrical cathode is coaxial with and surrounds a cylindrical anode.

A keep-alive grid 110 ("KA grid" or "first grid") is positioned between cathode 108 and anode 106 and defines a grid-to-cathode gap 112, which may be filled with an ionizable gas with low atomic mass, such as helium gas, hydrogen gas, or mixtures of hydrogen and helium. In the exemplary embodiment, gas pressures may range from 0.01-1.0 torr. For example, grid-to-cathode gap 112 may be filled from a gas storage reservoir, such as a hydrogen and/or helium reservoir (not shown) to a selected gas pressure in the range above. In various embodiments, there is only one interior gas volume within gas-tight housing 102, such that gas in grid-to-cathode gap 112 is in full communication with gas in a grid-to-anode gap 116 (described below).

In the exemplary embodiment, KA grid 110 is a substantially planar, electrically conductive, perforated structure. Specifically, KA grid 110 includes a plurality of perforations, apertures, or holes, sized to permit the flow of ionized gas (e.g., plasma) and electrons therethrough.

A control grid 114 (or "second grid") is also included in gas switch 100. Specifically, control grid 114 is positioned between KA grid 110 and anode 106 and defines a grid-to-anode gap 116 (or "high voltage gap"). Like KA grid 110, control grid 114 is a substantially planar, electrically conductive, perforated structure. Specifically, control grid 114 includes a plurality of perforations, apertures, or holes, sized to permit the flow of ionized gas (e.g., plasma) and electrons therethrough. In some embodiments, control grid 114 may be excluded from gas switch 100, in which case, gas switch 100 may function as a diode that is forward biased by a rising voltage and/or current pulse applied to anode 106.

A wire lead 118 extends through gas-tight housing 102 and is electrically and mechanically connected between KA grid 110 and a bias voltage supply 150 (or "power supply") arranged to provide a bias voltage to KA grid 110. Similarly, conductive ring 120 is mounted within gas-tight housing 102

(e.g., as described above) and is electrically and mechanically connected between control grid 114 and bias voltage supply 150, such that conductive ring 120 is arranged to provide a bias voltage to control grid 114. More particularly, and as described herein, conductive ring 120 may provide a reverse bias voltage to control grid 114 to "open" gas switch 100, and a forward bias voltage to control grid 114, to "close" gas switch 100.

A system of magnets 122 is also implemented in gas switch 100. Specifically, in the exemplary embodiment, a system of magnets is disposed in close proximity to cathode 108, such as, for example, under or below cathode 108. In some embodiments, system of magnets 122 is disposed in direct physical contact with lower surface 109 of cathode 108. In other embodiments, system of magnets 122 does not make direct physical contact with lower surface 109 but is disposed proximal to cathode 108, such that a magnetic field generated by system of magnets 122 extends through, about, and/or over cathode 108.

Figure 2:
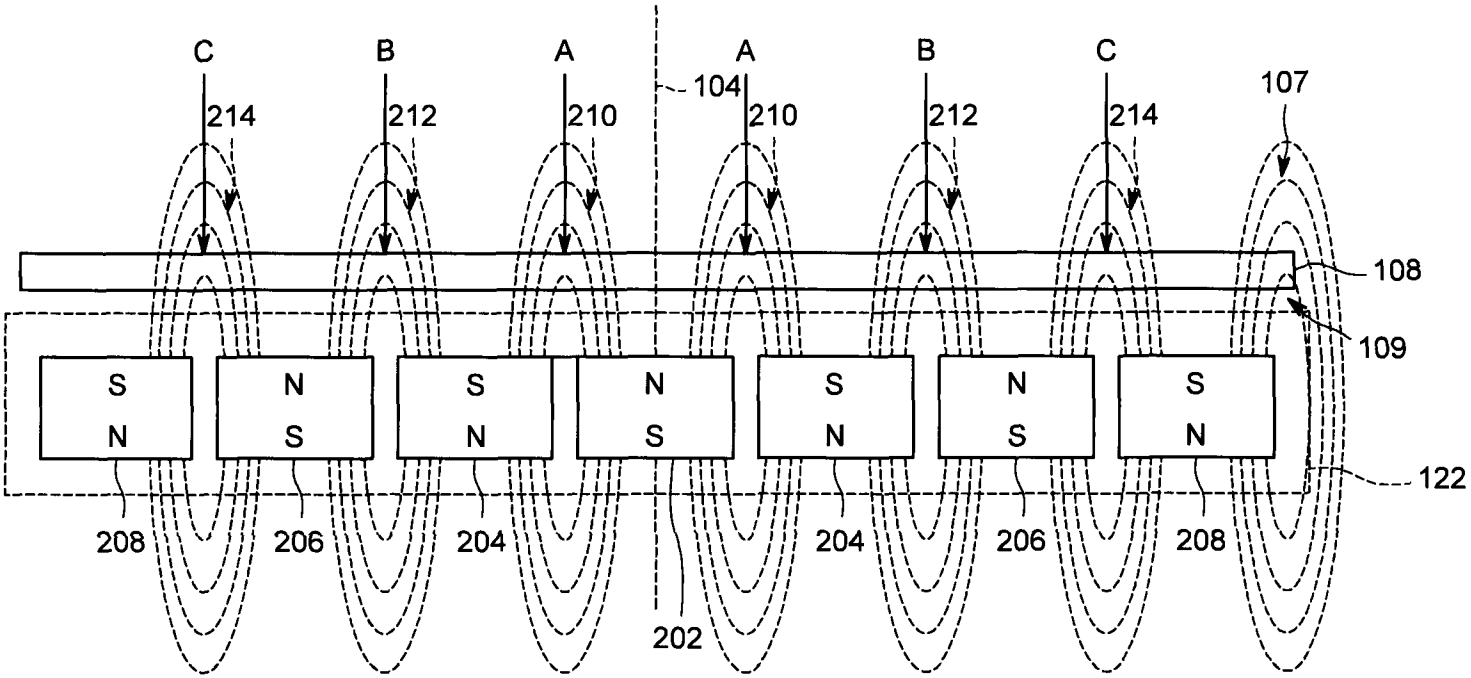
FIG. 2 is a cross-sectional view of an exemplary system of magnets that may be used with the gas switch shown at FIG. 1.

FIG. 2 is a cross-sectional view of system of magnets 122 (shown at FIG. 1). As shown, system of magnets 122 includes a plurality of magnets, such as a central magnet 202, a first ring magnet 204, a second ring magnet 206, and/or a third ring magnet 208. Although four magnets 202-208 are shown, in other embodiments, any suitable number of magnets may be incorporated in gas switch 100, such as, for example, to adjust ion behavior near conduction surface 107 (as described below).

In the exemplary embodiment, central magnet 202 is a dipole magnet, such as, for example an elongated cylindrical magnet having a single north pole and a single south pole. Ring magnets 204-208 are ring-shaped or toroidal dipoles and are arranged concentrically around central magnet 202. Although ring magnets are described herein, in various embodiments, any closed magnet may be implemented, such as a closed square-shaped magnet, a closed rectangular magnet, a closed ovoid or oval-shaped magnet, and the like. One racetrack (described below) is sufficient for operation; this one racetrack can be created by either a central pole magnet and an adjacent ring magnet, or by two adjacent ring magnets. In addition, in at least some embodiments, the north and south poles of each ring magnet 204-208 are axially aligned with switch axis 104. In addition, in some embodiments, pole and ring magnets 204-208 are alternatingly arranged, such as, for example, to achieve a north-south-north arrangement or a south-north-south arrangement. A north-south-north arrangement is shown at FIG. 2.

In operation, system of magnets 122 generates a magnetic field, such as, for example, a magnetic field extending between the alternatingly arranged north and south poles of magnets 202-208. More particularly, and as shown, a first group of magnetic field lines 210 may extend between central magnet 202 and first ring magnet 204. Likewise, a second group of magnetic field lines 212 may extend between first ring magnet 204 and second ring magnet 206, and a third group of magnetic field lines 214 may extend between second ring magnet 206 and third ring magnet 208.

In addition, each group of magnetic field lines 210-214 may pass under, over, and/or through cathode 108. Further, in some areas, the magnetic field lines generated by magnets 202-208 may extend substantially parallel to (or tangentially to) conduction surface 107 of cathode 108. For example, and as shown, first group of magnetic field lines 210 extends substantially parallel to conduction surface 107 over a first region, "A." Similarly, second group of magnetic field lines 212 extends substantially parallel to conduction surface 107 over a second region, "B," and third group of magnetic field lines 214 extends substantially parallel to conduction surface 107 over a third region, "C."

Regions A, B, and C may correspond to one or more annular conduction paths or "racetracks" on conduction surface 107. These features are not central to an understanding of the present disclosure and are not described in additional detail herein. However, additional information related to the operation of gas switch 100 with respect to regions A, B, and C as well as with respect to a low forward voltage drop mode of operation may be obtained with reference to U.S. patent application Ser. No. 15/860,225, filed Jan. 2, 2018, and entitled LOW VOLTAGE DROP, CROSS-FIELD, GAS SWITCH AND METHOD OF OPERATION, which is hereby incorporated by reference in its entirety.

To initiate operation of gas switch 100, and with returning reference to FIG. 1, a bias voltage is provided to KA grid 110, such as via wire lead 118, and a reverse bias voltage is applied to control grid 114, such as via conductive ring 120. The bias voltage applied to KA grid 110 energizes KA grid 110, such as to a voltage sufficient to weakly ionize the gas maintained in grid-to-cathode gap 112, while the reverse bias voltage applied to control grid 114 prevents passage of the ionized gas beyond and/or through control grid 114. Thus, KA grid 110 is forward biased and control grid 114 is reverse biased to create (and maintain or "keep alive") a relatively weak plasma in grid-to-cathode gap 112. In this condition, plasma is confined to grid-to-cathode gap 112, and gas switch 100 is "open," in that electrical current is unable to flow from anode 106 to cathode 108.

In some embodiments, KA grid 110 is excluded from gas switch 100. In such a case, no relatively weak "keep alive" plasma is maintained in grid-to-cathode gap 112. Rather, an initial plasma may be created when a cosmic ray impinges on the ionizable gas within gas switch 100, creating an initial or "seed" ionization in the ionizable gas. A cosmic ray can also impinge on an interior surface and eject a seed electron into the gas. The seed ionization is subsequently amplified by electron avalanching in the relatively high electric field developed within gas switch 100, leading to creation of a conducting plasma, as described below. However, to reduce the statistical uncertainty associated with reliance on an incident cosmic ray, KA grid 110 may be implemented in gas switch 100 to facilitate operation (e.g., turn on) of gas switch 100.

To "close" gas switch 100, a forward bias voltage is applied to control grid 114, such as via conductive ring 120, and a constant input voltage is applied at anode 106. In some embodiments, a forward bias voltage is applied to control grid 114, and a slowly varying input voltage is applied at anode 106, such as, for example, with respect to and/or in comparison to the characteristic time over which the forward bias voltage is applied to control grid 114. Specifically, anode 106 is charged to a voltage in the range of 10-1000 kilovolts, and a forward bias voltage in the range of 0-3 kilovolts (relative to cathode 108) is applied to control grid 114. As control grid 114 is energized to this voltage, the relatively weak "keep alive" plasma confined in grid-to-cathode gap 112 is electrically drawn through KA grid 110 towards control grid 114, and a conducting plasma (or a "plasma path") is established between control grid 114 and cathode 108. The plasma becomes more highly ionized (more conductive) when it is exposed to the higher voltage and electric fields that are created by the high anode voltage, after the control grid voltage is raised. In addition, the voltage applied to anode 106 will draw the conducting plasma (through control grid 114) into electrical contact with anode 106, extending the plasma path and completing the circuit between anode 106 and cathode 108.

Figure 3:
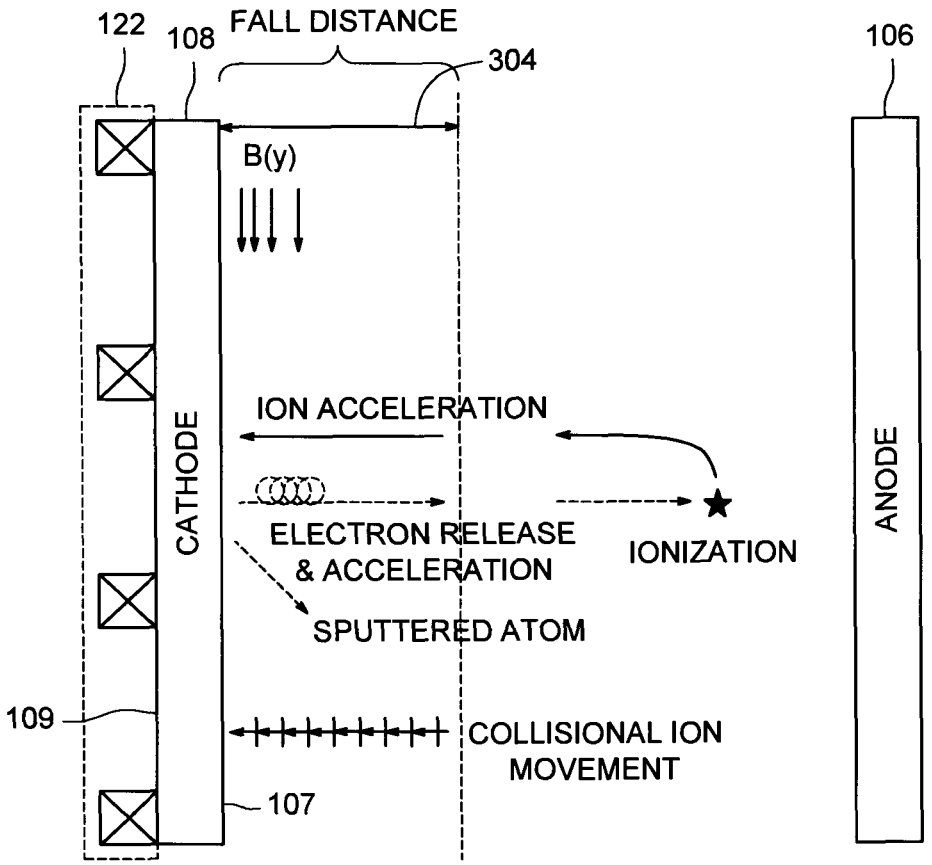
FIG. 3 is a schematic view illustrating operation of the gas switch shown at FIG. 1.
Figure 4:
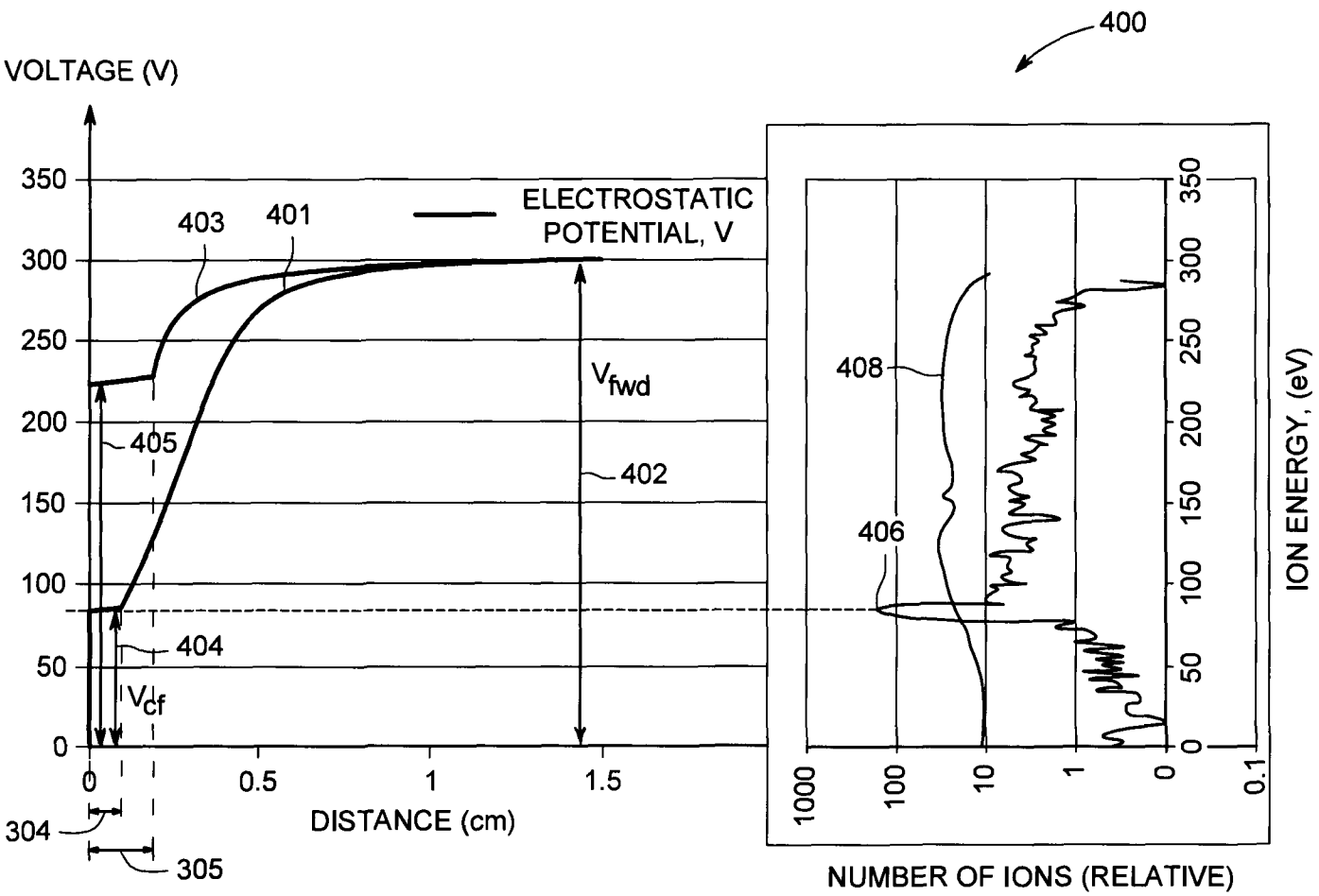
FIG. 4 is a chart illustrating a relationship between voltage and ion energy distribution during operation.

FIG. 3 is a schematic view illustrating ion behavior within gas switch 100 (shown at FIG. 1). Similarly, FIG. 4 is a chart 400 illustrating a relationship between voltage and ion energy distribution within gas switch 100. More particularly, chart 400 illustrates a first curve 401, in which a cathode fall voltage 404 is reduced according to the present disclosure, and a second curve 403 associated with a conventional gas switch, in which a cathode fall voltage 405 is not reduced, and in which ion impacts result in heavy cathode sputtering.

Accordingly, during operation and with primary reference to second curve 403, a voltage 402 is dropped between anode 106 and cathode 108 (also referred to as a "forward voltage drop"). The value of the forward voltage drop is determined mainly by the ionization potential of the gas and the probability that an incident ion will release an electron from a given cathode material. As shown in FIG. 3, to maintain the conducting plasma, each electron that is ejected from conduction surface 107 by an incident ion must create enough new ions in the gas, to ensure that one of them will return to conduction surface 107 to eject the next electron. The lower limit of the value of the forward voltage drop is fixed by the need for each electron to create a sufficient number of ions, usually in the range 3-30, for different combinations of gas type and cathode material, and does not depend strongly on the magnetic field.

The impact of an ion on conduction surface 107 can not only desirably eject an electron to sustain the conducting plasma, but it can also undesirably eject an atom or molecule of the cathode material, as shown in FIG. 3, leading to damage to cathode 108 that limits useful device life. It is important to note that the probability of undesirably sputtering an atom of cathode material increases with ion energy in the energy range of interest here (0-500 eV), whereas the probability of desirably ejecting an electron varies only slightly with ion kinetic energy, in this same energy range.

However, as described above, voltage 402 is not dropped uniformly in the space between anode 106 and cathode 108. Rather, much of voltage 402 is dropped within a predefined distance of conduction surface 107. Specifically, a "fall voltage" 404 is dropped within a "fall distance" 304 of conduction surface 107, and fall voltage 405 is dropped within fall distance 305 of conduction surface 107. It is possible to change fall voltage 404 and/or fall distance 304 by changing the properties of the magnetic field.

The possible range of ion energies 408 extends from zero up to a value that corresponds to the forward voltage drop. The reason that there is a distribution of ion energies 408, as shown in FIG. 4, rather than a single ion energy, is that the ions collide with gas atoms on their path to cathode 108, and can transfer a large fraction of their kinetic energy to the gas atoms, leading to reduced ion kinetic energy and increased thermal energy to the gas atoms, leading to gas-atom heating. The random nature of these energy-transfer collisions leads to a distribution of ion energies at conduction surface 107. If there is a sufficient flux of sufficiently energetic ions then much of conduction surface 107 can be rapidly "sputtered" off by (high energy) charged particles (e.g., ions) impinging on conduction surface 107 under the influence of fall voltage 404. If conduction surface 107 is sputtered in this manner, as is the case with many existing systems, the lifespan of gas switch 100 may be reduced to a matter of several hours or days of conduction-phase operation.

As shown with reference to FIG. 4, in a region near conduction surface 107 (e.g., within fall distance 304 of conduction surface 107), the distribution of ion energies reaches a peak 406 at fall voltage 404, and ion energies at voltages greater than fall voltage 404 are substantially reduced.

Accordingly, to reduce sputtering (and extend the lifespan of gas switch 100), the magnetic field generated by system of magnets 122 may be adjusted or varied to reduce the kinetic energy of ions impinging on conduction surface 107. Specifically, the magnetic field may be varied to adjust one or both of: (1) fall distance 304 and/or (2) fall voltage 404.

More particularly, as fall distance 304 increases, ions accelerating or "falling" towards conduction surface 107 under the influence of fall voltage 404 and/or the magnetic field generated by system of magnets 122 experience a larger number of particle interactions (e.g., particle collisions) between their point of origin and conduction surface 107. Each particle interaction can reduce the kinetic energy associated with the accelerating particle, and, correspondingly, the sputter damage caused by the particle. Similarly, fall voltage 404 may be reduced to reduce the electric force that acts on ions in the region near conduction surface 107. More particularly, as the electric force attracting ions to conduction surface 107 weakens, ion speed (e.g., kinetic energy) is correspondingly reduced, resulting in less sputter damage and increased cathode longevity.

Thus, a variety of adjustments may be made to the magnetic field generated within gas switch 100 to reduce sputter damage to cathode 108. For example, the magnetic field may be adjusted to increase fall distance 304, which may slow ions accelerating towards conduction surface 107. Likewise, the magnetic field may be adjusted to decrease fall voltage 404, resulting in slower moving (and less damaging) ion impacts on conduction surface 107.

In the exemplary embodiment, the geometry of system of magnets 122 (e.g., magnets 202-208) may be determined from the following equation, which expresses the magnetic field, B(y), as a function of distance, y, from system of magnets 122. Specifically, the geometry of system of magnets 122 may be selected, based on the following equation, to adjust fall distance 304 and/or fall voltage 404.

$$B(y) = \frac{2Myd}{\left(\frac{d^2}{4} + y^2\right)^2},$$

where M is a dipole strength per unit length, and d is a distance between magnet centerlines. This simple expression is for an infinite array of magnets, where it is possible to approximate the magnetic field above locations A, B, and C in FIG. 2 in a more intuitive form. A computer model of the magnetic field can be used to obtain more accurate three-dimensional results for a specific magnet geometry.

The equation above may be rearranged to identify a distance from system of magnets 122 where the magnetic field is greatest. In addition, a maximum magnetic field, $B(y_{max})$, may be determined from the equation above. More particularly:

$$y = \frac{d}{2\sqrt{3}} = 0.29d$$

$$B(y_{max}) = 5.2\frac{M}{d^2}$$

Thus, the geometry of system of magnets 122 may be modified or adjusted to vary the location and strength of the magnetic field, which may in turn be used to influence or control one or both of fall distance 304 and/or fall voltage 404. More particularly, one or more magnets 202-208 may be selected and/or selectively positioned to adjust fall distance 304, such as by adjusting the location or distance, y, where the magnetic field is greatest. In the exemplary embodiment, increased fall distances 304 are associated with larger values of y. Likewise, one or more magnets 202-208 may be selected and/or selectively positioned to adjust fall voltage 404. For instance, fall voltage 404 may be adjusted by varying the strength of the maximum magnetic field, $B(y_{max})$, such as by varying magnet strength, M, and/or the distance between magnets 202-208, d. In the exemplary embodiment, decreased fall voltages 404 are associated with greater spacing between magnets 202-208 (e.g., larger values of d) and/or the use of stronger dipole magnets 202-208 (e.g., larger M values).

Accordingly, in some embodiments, system of magnets 122 is arranged such that a maximum magnetic field, $B(y_{max})$ is in the range of 100-1,000 Gauss. In addition, the maximum magnetic field strength occurs, in at least some embodiments, at a distance, y, in the range of 1-10 millimeters (mm) from conduction surface 107. However, in other embodiments, the maximum magnetic field strength occurs at a distance, y, in the range of 2-5 millimeters (mm) from conduction surface 107. With reference to the relation between the location y of the maximum field and the magnet spacing d, above, and accounting for a 1 mm-thick cathode 108, the distance between magnet centerlines may, in some embodiments, be 7-38 mm, and may, in other embodiments, be 10-21 mm. Further, in the exemplary embodiment, a value of the magnetic field at conduction surface 107 is less than $B(y_{max})$. For example, in some embodiments, the value of the magnetic field at conduction surface 107 is less than $0.5*B(y_{max})$. In another embodiment, the value of the magnetic field at conduction surface 107 is less than $0.2*B(y_{max})$.

Thus, in various embodiments, system of magnets 122 are selectively arranged to generate a magnetic field proximate conduction surface 107 that reduces the kinetic energy of charged particles striking conduction surface 107 and/or increases a current density at conduction surface 107 to technically useful levels (e.g., greater than approximately 0.1 Ampere/centimeter$^2$, and in some cases, greater than 1.0 Ampere/centimeter$^2$)

Figure 5:
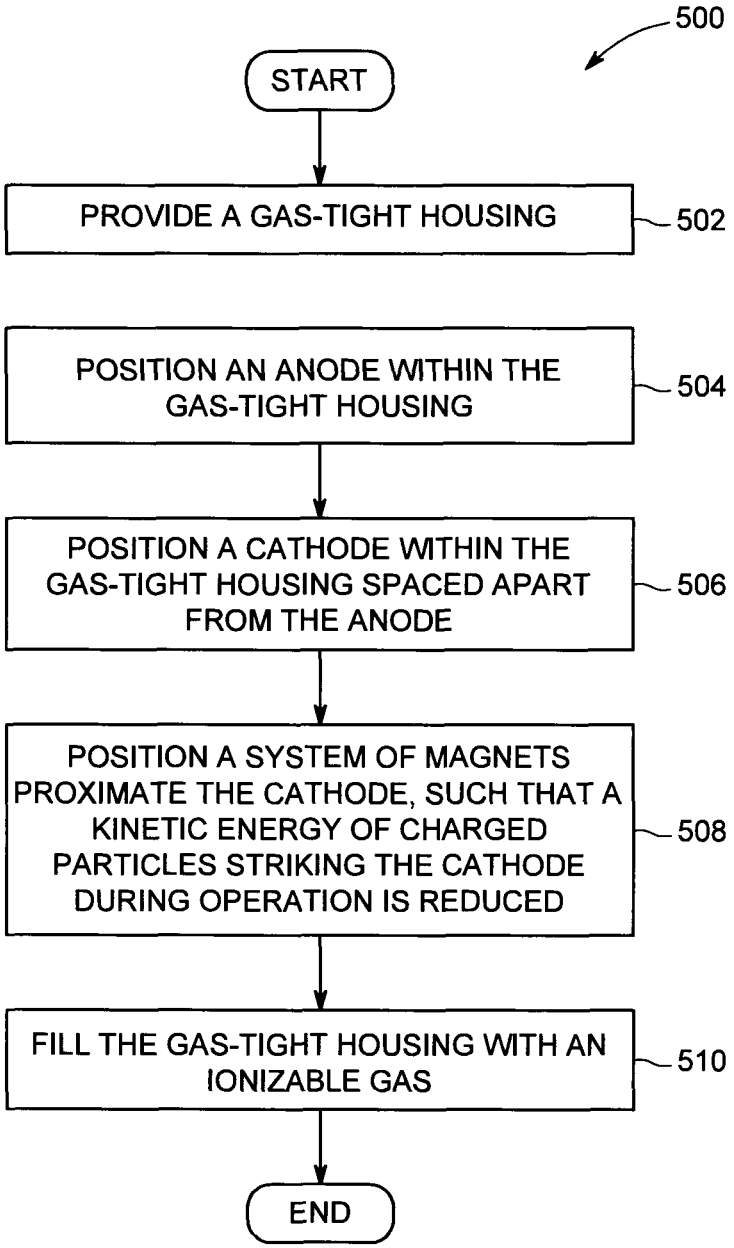
FIG. 5 is a flowchart illustrating an exemplary process of manufacturing the gas switch shown at FIG. 1.

FIG. 5 is a flowchart illustrating an exemplary process 500 for manufacturing gas switch 100. Accordingly, in at least one embodiment, gas-tight housing 102 is provided (step 502), and cathode 108 and anode 106 are positioned therein, as described above (steps 504 and 506). In addition, system of magnets 122 is positioned proximate cathode 108, such that the kinetic energy of charged particles (e.g., ions) striking conduction surface 107 of cathode 108 during operation is reduced (step 508). Finally, gas-tight housing 102 is filled with an ionizable gas, such as hydrogen, helium, and/or any combination thereof, and gas-switch 100 is sealed for deployment and operation (step 510).

Embodiments of the present disclosure therefore relate to a gas switch that includes a system of magnets arranged in proximity to a cathode conduction surface. One or more design parameters associated with the system of magnets may be varied during manufacture to adjust the properties of a magnetic field generated by the system of magnets. For example, a location of a maximum magnetic field may be adjusted and/or a maximum magnetic field strength may be adjusted, such as by varying a distance between dipole magnets in the system of magnets and/or a magnetic field strength of the dipole magnets themselves. As the properties of the magnetic field are adjusted, the kinetic energy (e.g., a speed) of charged particles (e.g., ions) impacting the cathode conduction surface is reduced, facilitating a reduction in sputtering on the conduction surface.

Exemplary technical effects of the gas switch described herein include, for example: (a) reduction of the kinetic energy of charged particles accelerating towards a cathode conduction surface by increasing a fall distance to the cathode conduction surface; (b) reduction of the kinetic energy of charged particles accelerating towards the cathode conduction surface by decreasing a fall voltage dropped over the fall distance; (c) reduction of sputtering on the cathode conduction surface by reducing the kinetic energy of charged particles striking the surface as well as raising the conduction current density at the cathode surface to technically useful levels; (d) reduction of waste heat generated by the gas switch; and (e) increased lifespan of the gas switch.

Exemplary embodiments of a gas switch and related components are described above in detail. The system is not limited to the specific embodiments described herein, but rather, components of systems and/or steps of the methods may be utilized independently and separately from other components and/or steps described herein. For example, the configuration of components described herein may also be used in combination with other processes, and is not limited to practice with the systems and related methods as described herein. Rather, the exemplary embodiment can be implemented and utilized in connection with many applications where a gas switch is desired.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gas switch, comprising:

a gas-tight housing containing an ionizable gas;

an anode disposed within said gas-tight housing;

a cathode disposed within said gas-tight housing, said cathode comprising a conduction surface;

a control grid positioned between said anode and said cathode, said control grid arranged to receive a bias voltage to establish a conducting plasma between said anode and said cathode; and a plurality of magnets selectively arranged to generate a magnetic field proximate said conduction surface that reduces the kinetic energy of charged particles striking said conduction surface, wherein said plurality of magnets are further arranged, such that a maximum magnetic field strength of the magnetic field is greater than 100 Gauss.

2. The gas switch of claim 1, wherein said plurality of magnets are further arranged, such that a maximum magnetic field of the magnetic field is greater than 500 Gauss.

3. The gas switch of claim 1, wherein said plurality of magnets are further arranged, such that a maximum magnetic field strength of the magnetic field is greater than 1,000 Gauss.

4. The gas switch of claim 1, wherein said plurality of magnets are further arranged, such that a maximum magnetic field strength of the magnetic field occurs in a range of 1-10 millimeters from said conduction surface.

5. The gas switch of claim 1, wherein said plurality of magnets are further arranged, such that a magnetic field strength of the magnetic field at said conduction surface is less than half a maximum magnetic field strength.

6. The gas switch of claim 1, wherein said gas-tight housing contains least one of i) hydrogen gas, ii) helium gas, and iii) a mixture of hydrogen gas and helium gas.

7. The gas switch of claim 1, wherein said cathode comprises at least one of i) tantalum, ii) molybdenum, iii) tungsten, iv) gallium, v) gallium-indium, vi) gallium-tin, vii) gallium-indium-tin, viii) aluminum, ix) tungsten, and x) stainless steel.

8. The gas switch of claim 1, wherein the magnetic field extends at least a distance from said conduction surface, wherein the magnetic field controls a voltage drop over the distance, and wherein said plurality of magnets are configured to at least one of i) increase the distance and ii) reduce the voltage drop over the distance.

9. The gas switch of claim 1, wherein said plurality of magnets comprise at least one annular magnet arranged circumferentially about a lower surface of said cathode.

10. The gas switch of claim 1, wherein said plurality of magnets comprise a plurality of concentrically arranged annular magnets disposed circumferentially about a lower surface of said cathode and a central magnet disposed proximal the lower surface of said cathode along a switch axis.

11. A gas switch, comprising:

an anode;

a cathode defining an interior volume between said anode and said cathode;

an ionizable gas filling the interior volume; and a system of magnets disposed proximate said cathode, said system of magnets selectively arranged to generate a magnetic field that reduces the kinetic energy of charged particles striking said cathode, wherein said system of magnets is further arranged, such that a maximum magnetic field strength of the magnetic field is greater than 100 Gauss.

12. The gas switch of claim 11, wherein said system of magnets is further arranged, such that a maximum magnetic field strength of the magnetic field occurs in a range of 1-10 millimeters from a conduction surface of said cathode.

13. The gas switch of claim 11, wherein said system of magnets is further arranged, such that a magnetic field strength of the magnetic field at a conduction surface of said cathode is less than half a maximum magnetic field strength.

14. The gas switch of claim 11, wherein said ionizable gas comprises at least one of i) hydrogen gas, ii) helium gas, and iii) a mixture of hydrogen gas and helium gas.

15. The gas switch of claim 11, wherein said cathode comprises at least one of i) tantalum, ii) molybdenum, iii) tungsten, iv) gallium, v) gallium-indium, vi) gallium-tin, vii) viii) aluminum, ix) tungsten, and x) stainless steel.

16. The gas switch of claim 11, wherein said cathode comprises a conduction surface, wherein the magnetic field extends at least a distance from said conduction surface, wherein the magnetic field controls a voltage drop over the distance, and wherein said system of magnets is configured to at least one of i) increase the distance and ii) reduce the voltage drop over the distance.

17. The gas switch of claim 11, wherein said system of magnets comprises at least one annular magnet arranged circumferentially about a lower surface of said cathode.

18. A method for manufacturing a gas switch, said method comprising:

providing a gas-tight housing;

positioning a cathode within the gas-tight housing, the cathode comprising a conduction surface;

positioning an anode within the gas-tight housing;

selectively positioning a plurality of magnets proximate the cathode, the plurality of magnets arranged to reduce the kinetic energy of charged particles striking the conduction surface of the cathode during operation; and filling the gas-tight housing with an ionizable gas, wherein said plurality of magnets are further arranged, such that a maximum magnetic field strength of the magnetic field is greater than 100 Gauss.

* * * * *